US006595278B1

(12) United States Patent
Lam et al.

(10) Patent No.: US 6,595,278 B1
(45) Date of Patent: Jul. 22, 2003

(54) ASSEMBLY FOR LOCKING A POLISHED ROD IN A PUMPING WELLHEAD

(75) Inventors: Tony M. Lam, Edmonton (CA); Abram Khazanovich, Edmonton (CA); Irina Khazanovich, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 8 days.

(21) Appl. No.: 10/052,040

(22) Filed: Jan. 17, 2002

(51) Int. Cl.[7] ..... E21B 14/00; E21B 43/00
(52) U.S. Cl. ..... 166/75.14; 166/68.5
(58) Field of Search ..... 166/68, 68.5, 75.11, 166/75.14, 84.1

(56) References Cited

U.S. PATENT DOCUMENTS 5,577,556 A * 11/1996 Reed ..... 166/75.14
5,615,736 A * 4/1997 Reed ..... 166/84.1
5,732,777 A * 3/1998 Grimshaw et al. ..... 166/78.1
6,026,898 A * 2/2000 Bland et al. ..... 166/78.1
6,192,981 B1 * 2/2001 Boquet et al. ..... 166/75.14
6,223,819 B1 * 5/2001 Heinonen ..... 166/75.14
2001/0050168 A1 * 12/2001 Hult ..... 166/68.5

* cited by examiner

*Primary Examiner*—David Bagnell
*Assistant Examiner*—Brian Halford
(74) *Attorney, Agent, or Firm*—Sheridan Ross PC

(57) ABSTRACT

The assembly functions to clamp onto and frictionally engage the polished rod of a well's rod string, with sufficient force to suspend the string from the wellhead. The assembly comprises an annular body forming opposed, radial, internally threaded side openings extending from its outer circumferential surface to its central vertical bore. An externally threaded locking member is positioned in each side opening and protrudes externally. The locking members can be manually threaded inwardly to engage the polished rod. An external leverage assembly is anchored to the body and engages one of the locking members. This leverage assembly can be manually turned to tighten the locking member against the polished rod with powerful axial force to provide enhanced gripping.

8 Claims, 18 Drawing Sheets

ASSEMBLY FOR LOCKING A POLISHED ROD IN A PUMPING WELLHEAD

BACKGROUND OF THE INVENTION

The present invention has to do with wellhead equipment used in connection with a pumping oil well, preferably one pumped with a rotated rod string. For years, a typical conventional pumping wellhead for a rotary pumping oil well has been constructed as shown in FIG. 1. The assembly comprises from the bottom up: a flanged casing head attached to the well casing; a flanged tubing head having an internal hanger from which the well tubing string is suspended; a tubing head adapter having a flanged connection at its bottom end and a threaded connection of smaller diameter at its top end; a production blow-out preventer (B.O.P) body having top and bottom threaded connections and including side openings for receiving the B.O.P. ram components; a flow tee body having threaded bottom and top connections and a threaded or flanged side opening for connecting with a flow line; a polished rod stuffing box; and a rotary drive assembly for rotating the well's rod string to power a downhole progressive cavity pump. These components, except for the rotary drive assembly, combine to form a vertical central bore extending therethrough. The polished rod of the rod string extends through this central bore.

The combination of the tubing head adapter, B.O.P. body and flow tee body components is commonly collectively referred to as a 'pumping tree'.

The assembly of wellhead components above the tubing head is usually referred to collectively as the 'Christmas tree'.

A recent improvement in the production wellhead art is disclosed in Canadian patent 2,197,584, issued Jul. 7, 1998 and re-issued May 16, 2000. This patent is owned by the present applicant. More particularly, this patent teaches integrating the tubing head adapter, B.O.P. body and flow tee body into a unitary structure, referred to as an 'integral or composite pumping tree', by forging, casting or machining a single steel body. The composite pumping tree is illustrated in prior art FIGS. 2 and 2*a* and forms the lower end of the Christmas tree.

Another recent improvement in the production wellhead art is disclosed in Canadian patent application 2,280,581, filed by the present applicant. This patent application teaches integrating a tubing head adapter, shut-off valve body, B.O.P. body, and flow tee body into a composite pumping tree. This pumping tree is illustrated in prior art FIG. 3.

As previously stated, the rotary drive assembly usually has a stuffing box at its bottom end. The primary function of the stuffing box is to prevent upward leaking of fluid around the rotating polished rod. The stuffing box comprises a body or housing containing annular packing, which seals between the housing and the polished rod of the rod string.

Rotation of the polished rod eventually produces wear of the stuffing box packing. Therefore, changing the packing is part of the regular oilfield maintenance program.

Prior art FIGS. 1, 2 and 3 show a rotary drive assembly mounted to the stuffing box by an 'open' frame. The frame has side 'windows' which enable access to the stuffing box packing gland, so as to change out the packing. However this frame introduces significant vertical separation between the rotary drive assembly and the pumping tree. This is undesirable as the rotary drive assembly vibrates when operating and applies offset forces that can create damage to the wellhead below. It is desirable to minimize the spacing between the rotary drive assembly and the pumping tree.

A modified rotary drive assembly is shown in FIG. 4. In this unit, the stuffing box housing is now integral with the rotary drive assembly. This variation has had the benefit of shortening the distance between the rotary drive assembly and the pumping tree.

However, it is more difficult to change out the packing of the stuffing box illustrated in FIG. 4. This process now requires:

- shutting off the rotary drive assembly;
- closing the production B.O.P by rotating the ram screws to advance the B.O.P rams into engagement with the polished rod;
- providing a service rig having a line which is attached to the polished rod to suspend the rod string;
- disconnecting the rod clamp normally suspending the rod string from and drivably connecting it with the rotary drive assembly;
- disconnecting the rotary drive assembly from the pumping tree;
- lifting the rotary drive assembly up using a second line from the service rig;
- securing a rod clamp to the polished rod below the rotary drive assembly, to secure the rod string;
- then fully removing the rotary drive assembly;
- replacing the packing; and
- re-assembling the equipment.

This process can also be dangerous. Since the rod string is driven and rotated, it has a built-in torque. This torque can generate a back-spin force, which can cause injury to personnel in various situations.

With this background in mind, it is an objective of the present invention to provide a polished rod locking assembly, forming part of the pumping tree and preferably being an integral component of the tree, which locking assembly can be actuated to clamp onto the polished rod to prevent back-spin and to grip the polished rod with sufficient force so as to suspend the weight of the rod string.

It is another objective to provide a leverage assembly in conjunction with the locking assembly, which is operative to apply high axial torque to the locking means to better secure the rod string.

It is another objective to provide a locking means capable of functioning like a blind ram to seal off the vertical bore of the wellhead, when the polished rod has parted in the stuffing box.

SUMMARY OF THE INVENTION

In accordance with one aspect of the invention, a polished rod locking assembly ("PRL assembly") is provided for inclusion as part of the pumping tree of a wellhead. This PRL assembly can be closed to clamp onto and frictionally engage the polished rod, to prevent back-spin, and to grip it with sufficient force so as to be able to suspend the rod string from the wellhead during stuffing box maintenance. These actions and results are hereafter collectively referred to as "securing" the polished rod. More particularly, the PRL assembly comprises:

- body means, which may be a separate component in a pumping tree formed of connected components or which preferably is integrated into a one piece integral pumping tree;

the body means forms a central bore (which forms part of the pumping tree vertical bore) and a pair of opposed, preferably horizontal, radial side openings. The side openings are internally threaded along part of their length and extend between the body means' outer peripheral surface and the central bore;

an externally threaded locking member is positioned in each body side opening. These locking members can be radially advanced to frictionally engage the polished rod. Each locking member preferally comprises an inner cylindrical member and an outer, rotatable, threaded shaft. The shaft functions, when rotated or screwed, to advance or retract the inner member. The cylindrical member and shaft are interconnected so that the inner member does not rotate while the rotating shaft pushes or pulls it. The inner member has a vertically grooved inner end face which will embrace the polished rod as it contacts and frictionally engages it. More preferably, the inner member is formed in two parts. The innermost part is horizontally pivotally connected to the outer part and there is a slight clearance between the two parts. The outer part closely fits the internal surface of the side opening and remains stationary. The innermost part can tilt to a limited extent to accommodate misalignment of the polished rod. Each locking member seals against the surface forming the side opening in which it is contained. The outer end of the locking member protrudes from the body means;

the inner end of an external lever arm is connected, preferably at right angle, with the protruding outer end of one of the locking members, for rotation or turning thereof. Movement of the outer end of the arm will cause the locking member to turn to a limited extent about its axis. Threaded means, such as a swing bolt having an annular head, is pivotally connected by means, such as a bolt, with the outer end of the arm. A post is anchored to the body means or tree. The post supports a rotatable sleeve at its outer end. The swing bolt extends through the opening formed by the sleeve. A nut, threaded on the end of the swing bolt, can be turned with relatively low torque to induce a relatively powerful lineal pull by the swing bolt on the arm. This causes relatively high torque to be applied to the locking member which in turn applies high lineal, inwardly directed force on the polished rod.

As a consequence, the locking members can be activated by hand turning their outer ends, to bring their inner end faces into firm contact with the polished rod. The arm and swing bolt assembly can then be introduced and operated to bias the locking member with considerable lineal force against the polished rod to ensure sufficient frictional engagement to secure the heavy rod string.

The specific described assembly provides a lever arm for turning the locking member and a mechanical means for biasing the arm's free end with a powerful lineal force to cause the locking member to secure the polished rod.

In another aspect, the PRL assembly is constructed so that it can operate as a "blind ram" to close the vertical bore of the pumping tree. More particularly, the body means and locking members are modified so that one locking member can retract sufficiently to enable the other locking member to extend across the vertical bore to close it. The other locking member carries seal means suitable for sealing the vertical bore from the radial openings when the locking member is in the closed position.

DESCRIPTION OF THE PREFERRED EMBODIMENT

Figure 1:
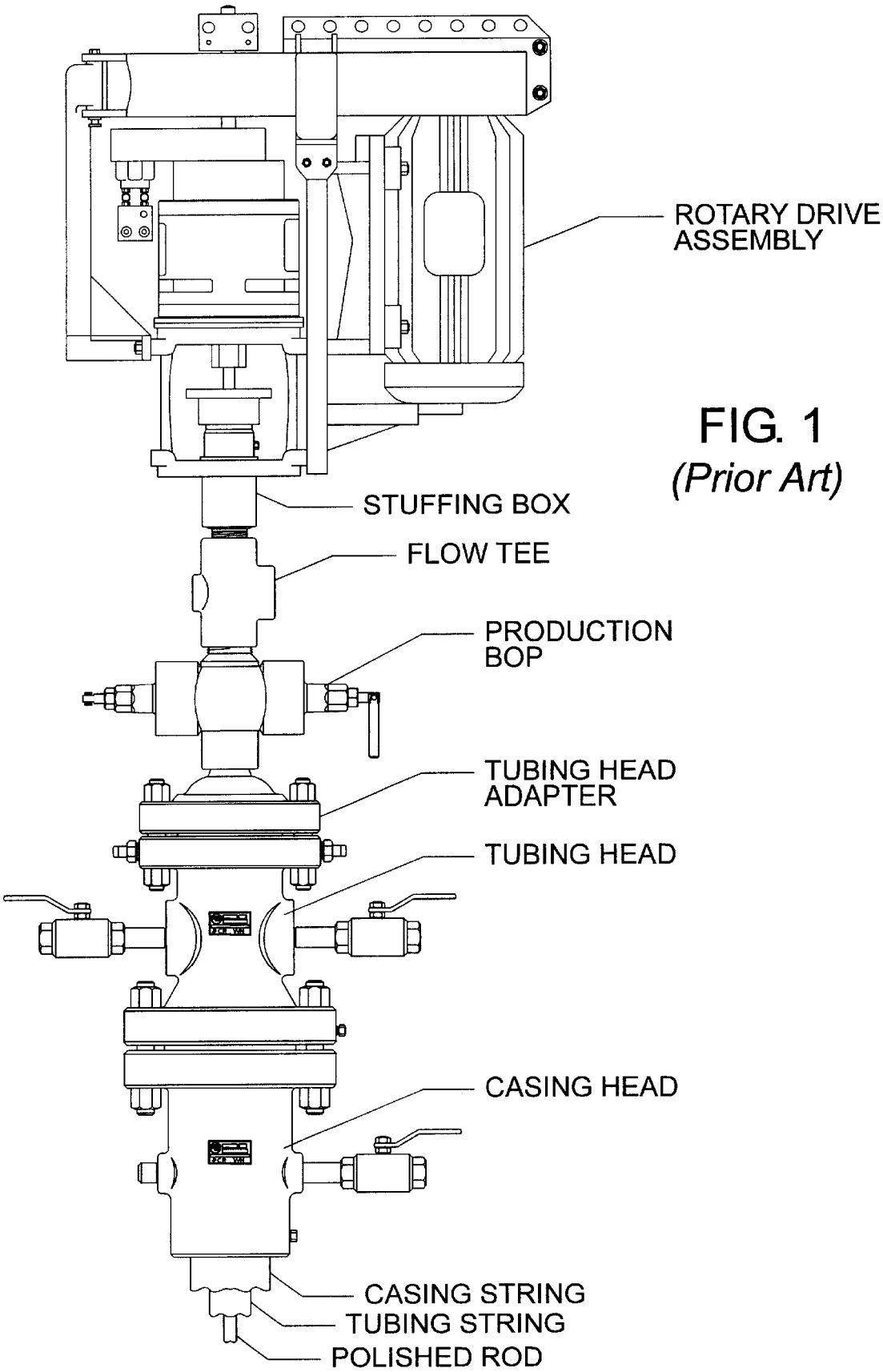
FIG. 1 (Prior Art)
FIG. 1 is a side view of a prior art wellhead for a rotary pumping well comprising a pumping tree formed of interconnected separate components, the wellhead having a rotary drive assembly at its upper end.
Figure 2:
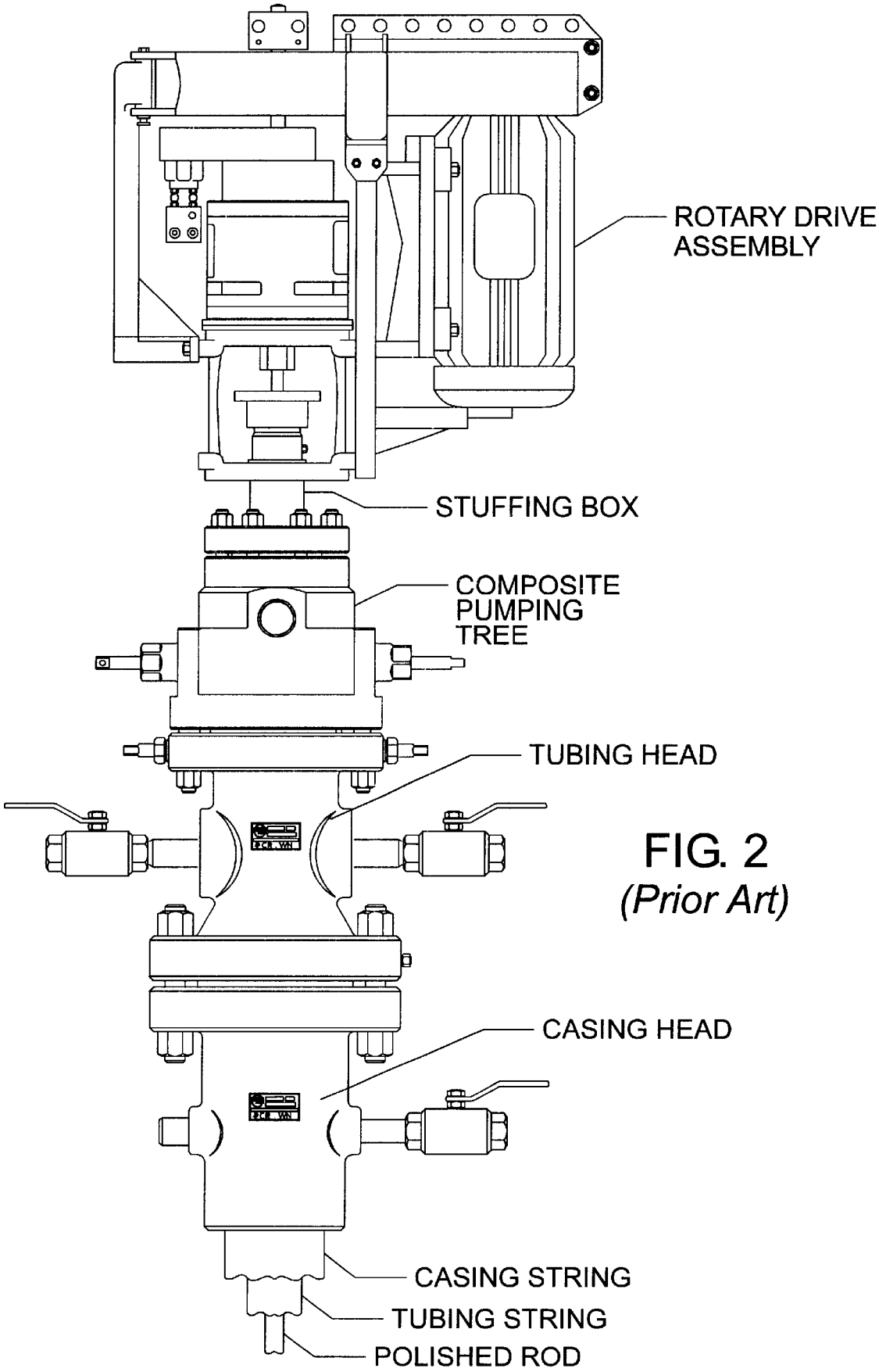
FIG. 2 (Prior Art)
FIG. 2 is a side view of a prior art wellhead for a rotary pumping well, incorporating an integral or composite pumping tree.
Figure 2A:
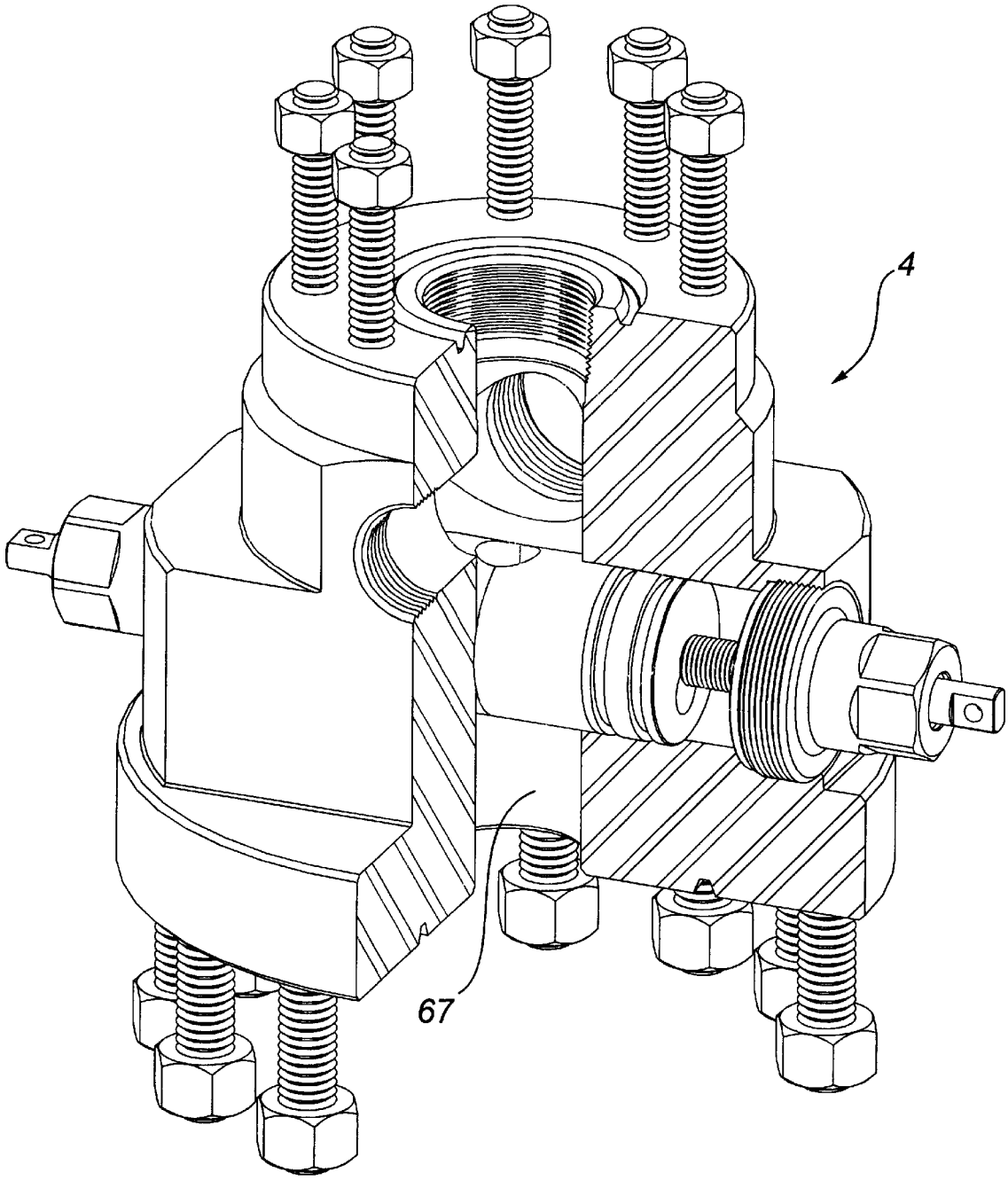
FIG. 2A (Prior Art)
FIG. 2*a* is a partly broken away perspective view of a prior art composite pumping tree.
Figure 3:
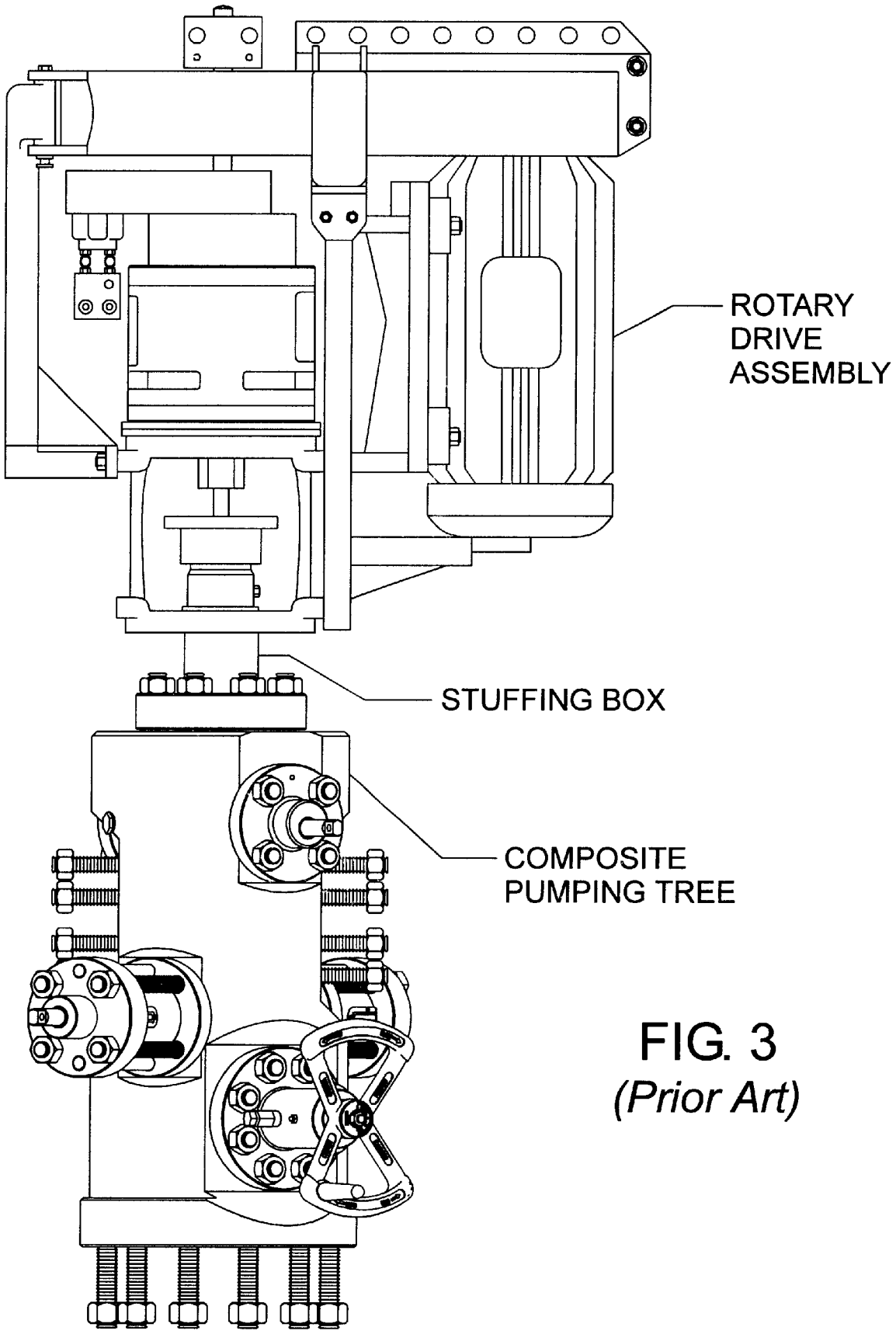
FIG. 3 (Prior Art)
FIG. 3 is a side view of a prior art wellhead incorporating an integral pumping tree having an integral shut-off valve.

One embodiment of the PRL assembly 1 is illustrated in FIGS. 4, 5, 7, 8 and 9. This PRL assembly 1 comprises a body means 2 having a vertical central bore 3 extending therethrough. The PRL assembly 1 forms part of the bottom connection 31 of an integral production pumping tree 4. The bottom connection 31 is adapted to mate and connect with the top connection 5 of a wellhead tubing head 6. The PRL assembly bore 3 forms part of the vertical internal bore 67 of the wellhead 7, through which the polished rod 8 extends and through which fluid is produced.

The body means 2 forms a pair of opposed horizontal radial openings 9 extending between its outer peripheral surface means 10 and the bore 3. Each radial opening 9 has inner and outer sections 11, 12. The opening sections 11, 12 have offset centerlines 14, 13. The outer opening section 12 has a larger diameter than the inner opening section 11, so that a shoulder 15 is formed at their junction.

A pair of cylindrical members 16 are positioned in the radial opening inner sections 11 and are slidable therealong. Each cylindrical member 16 has inner and outer ends 17, 18. The inner end 17 of the cylindrical member 16 has an end face 19 forming a vertical groove 100, for conforming with and engaging the polished rod 8.

Figure 8:
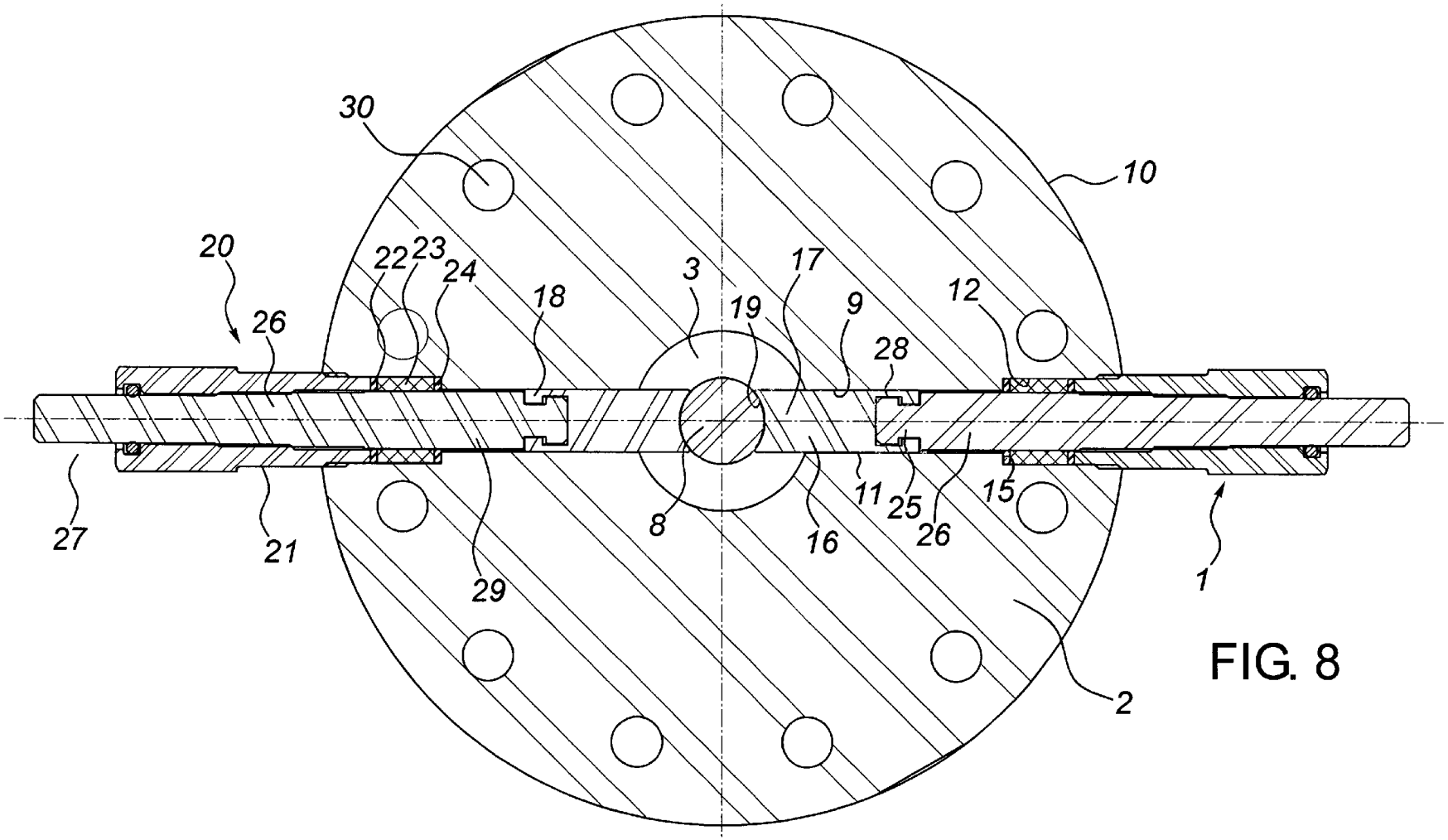
FIG. 8 is a plan view in section of the assembly of FIG. 7.
Figure 9:
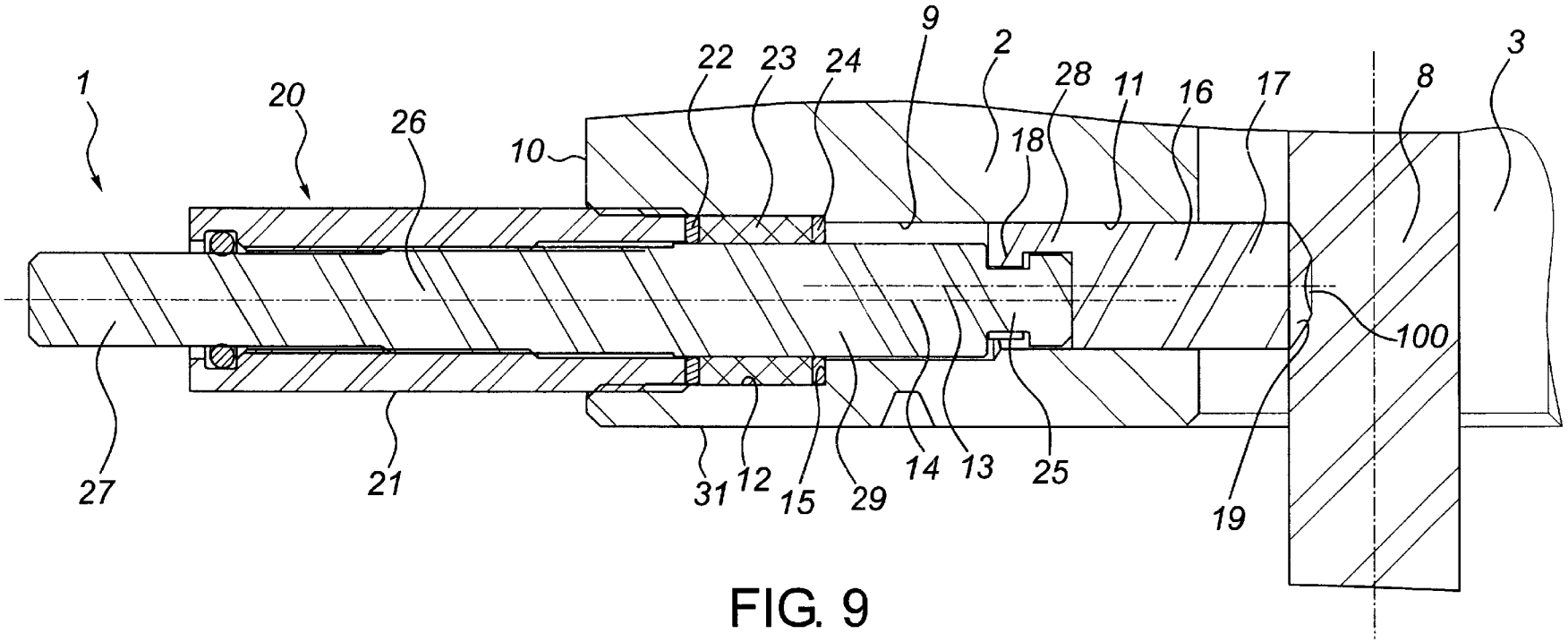
FIG. 9 is a sectional side view showing part of the PRL assembly of FIG. 7, positioned within a partly shown housing or body and engaging a polished rod.

A pair of tubular gland assemblies 20 are threaded into the opening outer sections 12. The gland assemblies 20 form part of the body means 2. In the embodiment of FIGS. 8 and 9, each gland assembly 20 comprises an externally threaded tube 21, an outer ring 22, packing 23 and an inner ring 24 abutting the shoulder 15. The threaded tube 21 can be actuated to energize the packing 23. The tube 21 is also internally threaded.

A pair of screws or shafts 26, having externally threaded outer ends 27, extend through the gland assemblies 20 and engage the outer ends 18 of the cylindrical members 16. The outer end 27 of each shaft 26 protrudes out of its associated gland assembly 20 so that it is accessible for rotation. The shaft 26 and cylindrical member 16 together make up a unit referred to as a locking member 50.

Each shaft 26 has a T-shaped head 25 at its inner end, which is received in a correspondingly T-shaped slot 28 formed in the outer end 18 of its associated cylindrical member 16. As a result of this connection and the offset centerlines, the shaft 26 and cylindrical member 16 are connected for axial movement together but the shaft can be turned without rotating the cylindrical member.

As illustrated, the PRL assembly radial openings 9 are positioned between stud holes 30 of the bottom connection 31 of the pumping tree 4.

It is to be noted that in this previously described embodiment:

- the body means 2 forms part of the bottom flanged connection 31 of an integral pumping tree 4; and
- the axial centerlines 14, 13 of each associated shaft 26 and cylindrical member 16 are offset and the two elements are connected by a T-shaped head 25 and slot 28 arrangement, whereby the elements are tied together and move as a unit axially, but the threaded shaft 26 (which generates the lineal locking force) can rotate without turning the cylindrical member 16 (which will be locked with the vertical rod 8).

In operation, each gland tube 21 can be screwed in, to compress its packing 23 and provide a seal around the unthreaded inner end 29 of the contained shaft 26. To lock the polished rod 8, the shafts 26 are advanced inwardly, biasing the locking members 16 into firm contact with the polished rod 8.

In a variant, the inner end portions of the polished rod locking members 16 can pivot to align with the polished rod 8, to thereby prevent damage to the rod's surface.

When the B.O.P. rams are closed about the polished rod 8, the latter can be tilted slightly. If the polished rod cylindrical members 16 are rigidly fixed and perpendicular to the axis of the bore 3, they can damage the tilted polished rod.

Figure 10:
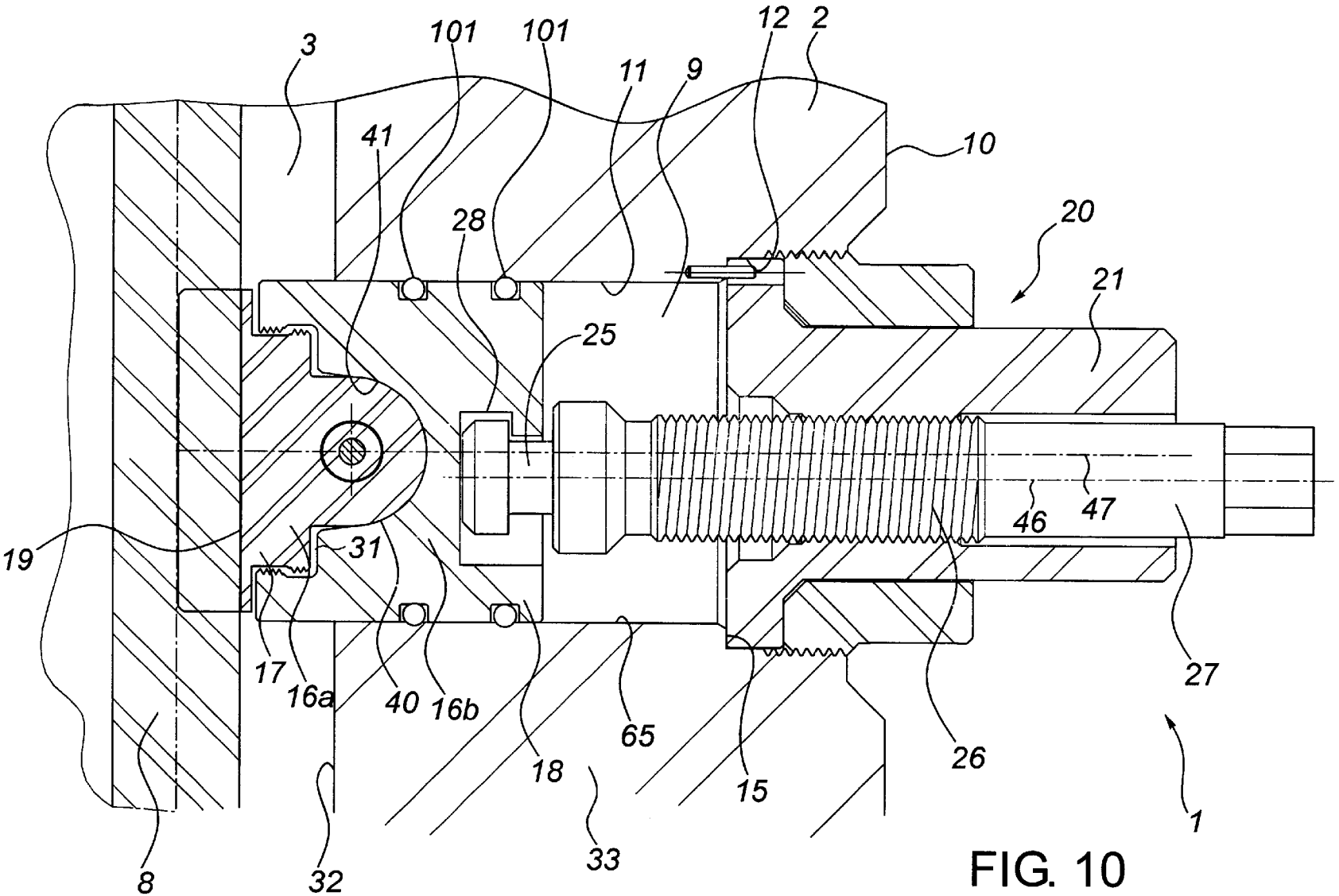
FIG. 10 is a sectional side view showing a self-aligning locking member positioned within a partly shown housing and engaging a polished rod.
Figure 11:
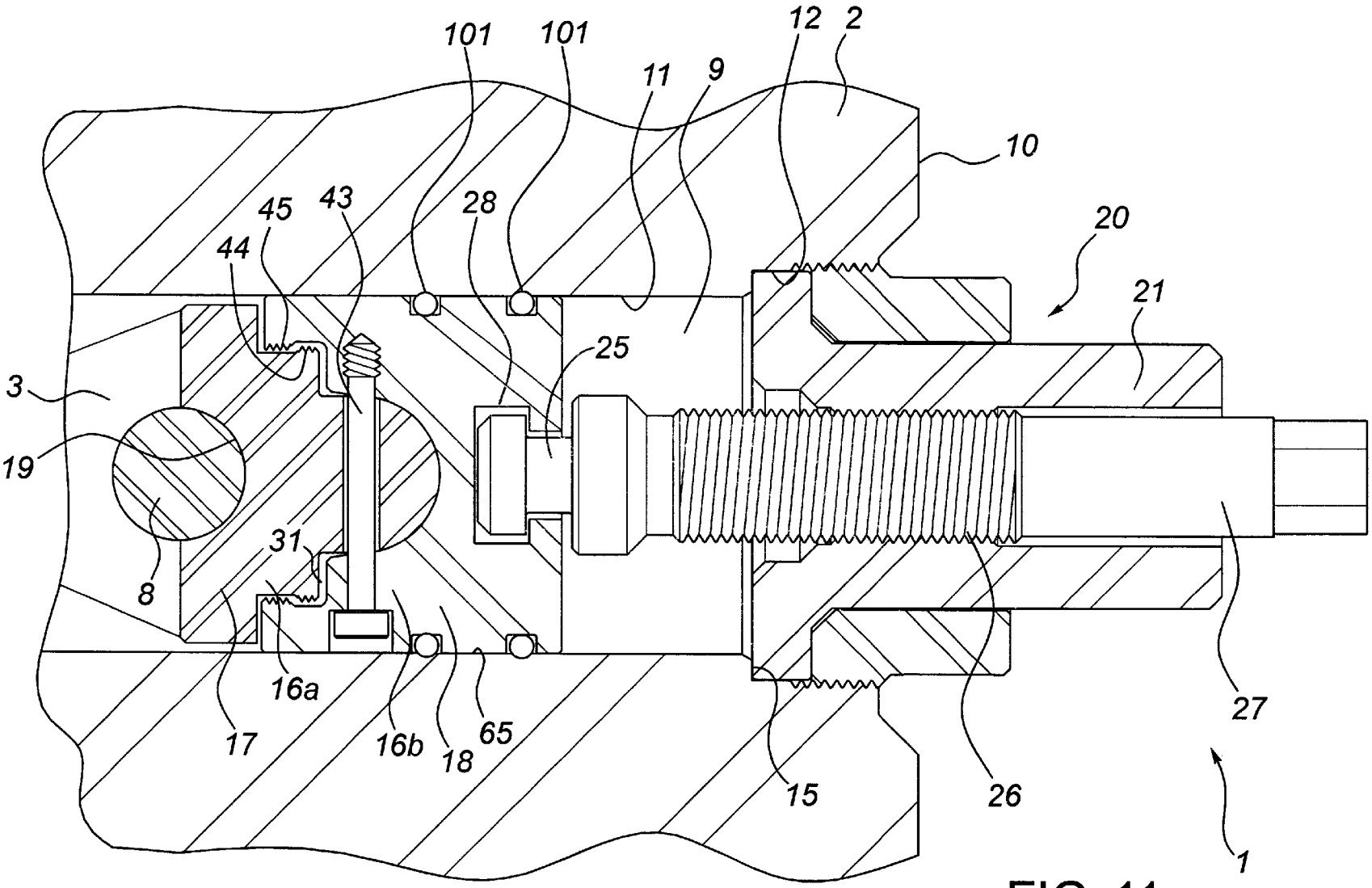
FIG. 11 is a sectional plan view of the assembly of FIG. 10.

In this alternative assembly, shown in FIGS. 10 and 11, each cylindrical member 16 is formed in two parts, an inner part 16*a* and an outer part 16*b*. The parts 16*a*, 16*b* are connected so that they move together axially as a unit, but inner part 16*a* can pivot slightly to self-align with the polished rod 8. More particularly the inner part 16*a* has a spherical nose 40 which is received in a spherical cavity 41 formed in the inner end of outer part 16*b*. There is a slight clearance 31 between the cylindrical member parts 16*a*, 16*b*. A horizontal bolt 43 holds the parts 16*a*, 16*b* together while allowing part 16*a* to pivot when it is fully inserted into the vertical bore 3 and has cleared the inner surface 32 of the tree side wall 33. To prevent the inner part 16*a* getting separated should the bolt 43 break, it has a short thread 44 which can be threaded past a short thread 45 formed by the outer part 16*b*. The shaft 26 has a centerline 46 and the cylindrical member 16 has a centerline 47, which centerlines are offset one from the other.

O-rings 101 are mounted around each cylindrical outer part 16*b*, for sealing against the adjacent inside surface 65 of the radial opening 9 in which the part is contained. It will be noted that the gland assembly 20 in this embodiment does not contain packing.

Figure 4:
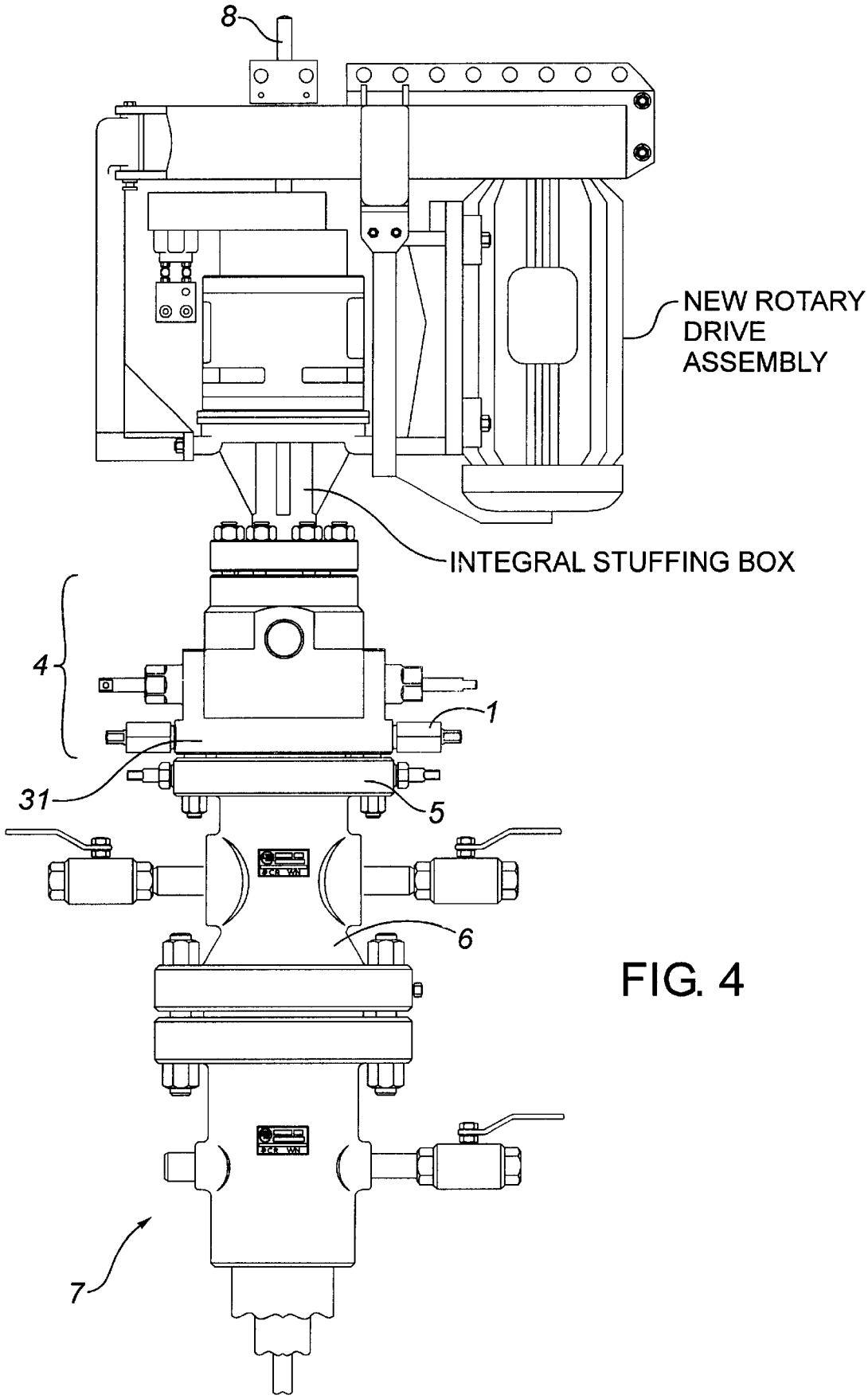
FIG. 4 is a side view of a wellhead for a rotary pumping well comprising an integral pumping tree and having a PRL assembly constructed as an integral part of the tubing head adapter, the wellhead having a rotary drive assembly incorporating an integral stuffing box.
Figure 5:
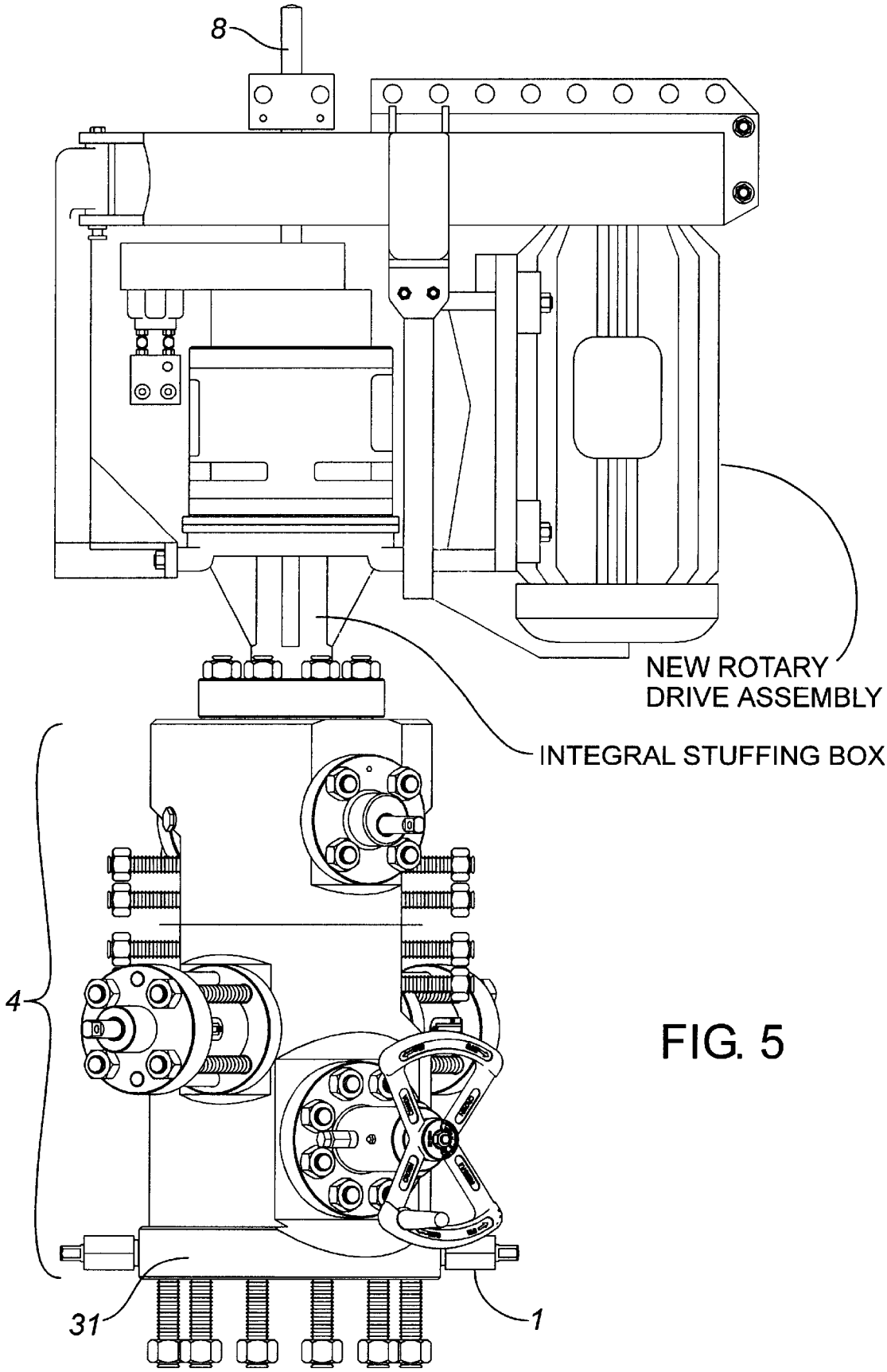
FIG. 5 is a side view of a wellhead incorporating an integral pumping tree having a shut-off valve and a PRL assembly constructed as an integral part of the tubing head adapter section of the tree.
Figure 6:
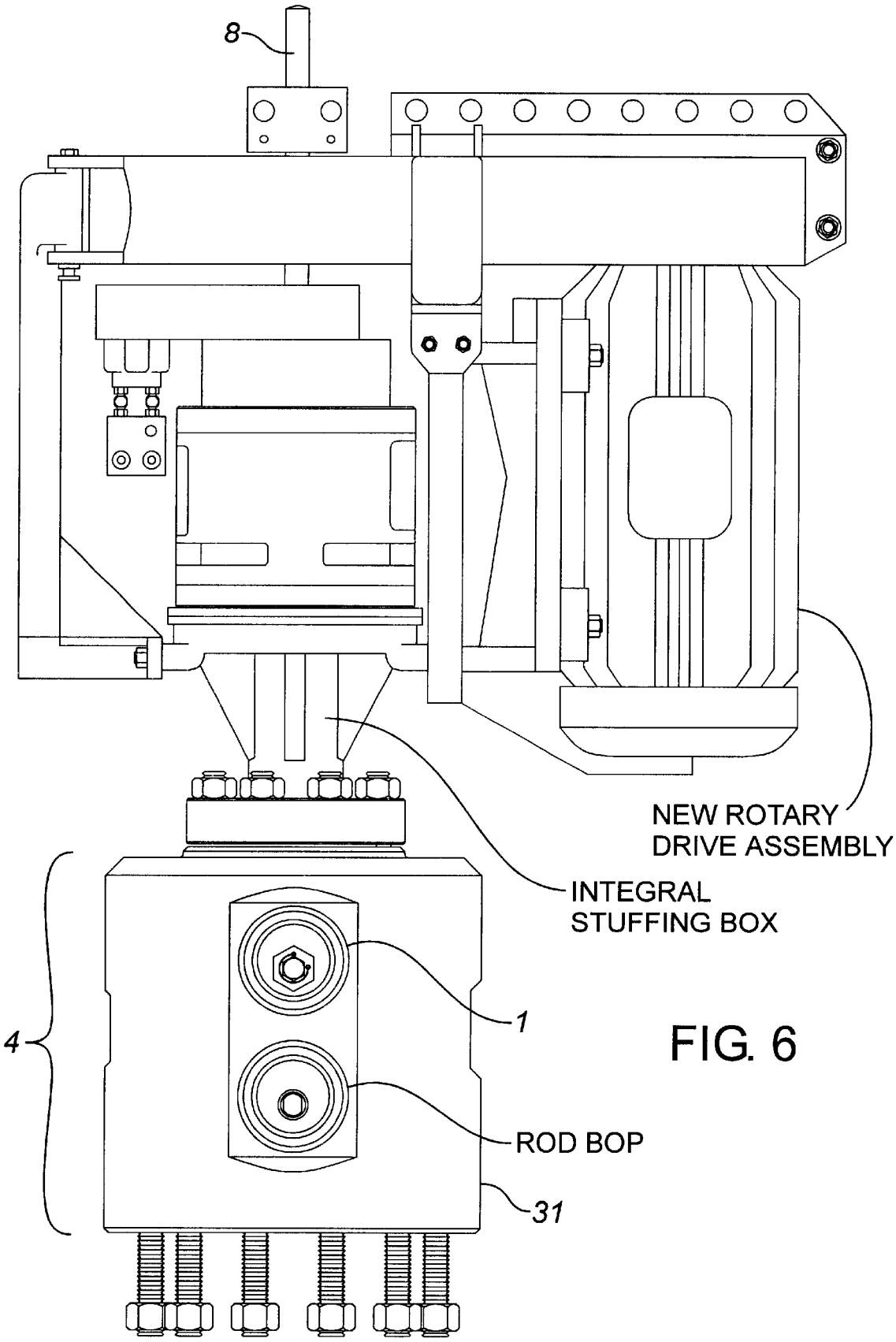
FIG. 6 is a side view of a wellhead incorporating an integral pumping tree having a PRL assembly located above the production rod B.O.P.
Figure 7:
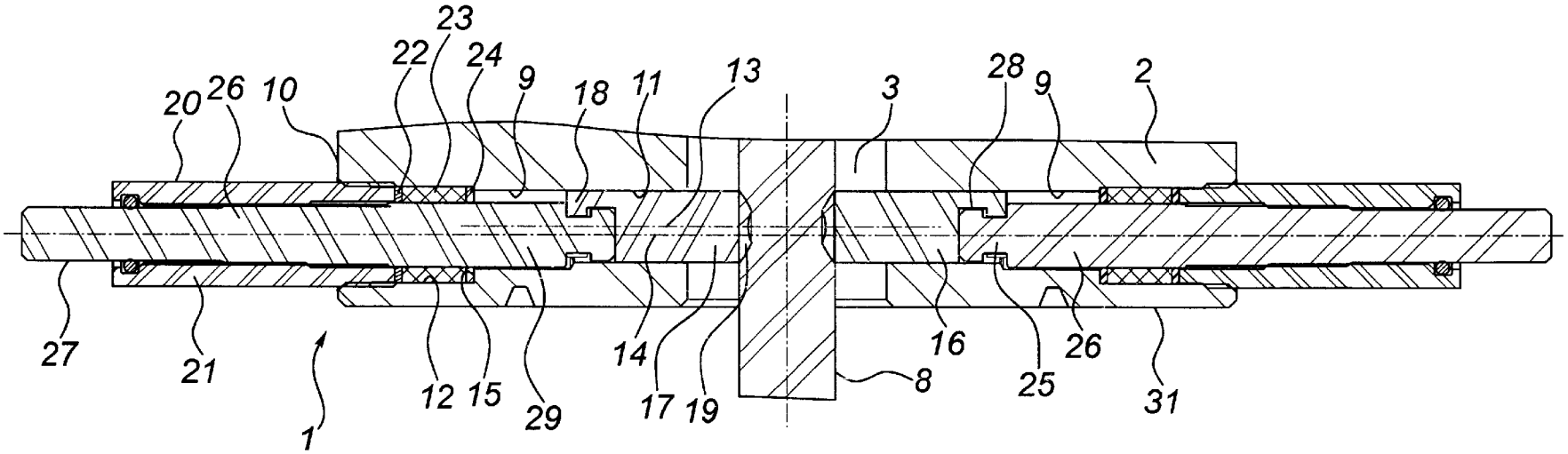
FIG. 7 is a side view in section of one embodiment of the PRL assembly.

The PRL assembly 1 has been described in terms of a body means 2 which is provided by two partial segments of the bottom connection 31, positioned between pairs of bolt holes 48 as shown in FIGS. 4, 5 and 18. This design is useful when the radial openings 9 are of relatively small diameter, as are the contained components. When it is desirable to use components of greater diameter, then the body means 2 involves a complete transverse layer of the tree 4, as shown in FIG. 6.

The PRL assembly 1 comprises a leverage assembly 51 which is designed with the following concept in mind:

- the shafts 26 can be hand turned with a wrench to bring the cylindrical member end faces 19 into firm contact with the polished rod 8—this is referred to as "hand tightening" the locking members 50;
- the leverage assembly 51 can then be used to apply a much greater rotational torque to one of the shafts 26 to thereby increase the frictional force with which the end faces 19 secure the polished rod 8.

Figure 12:
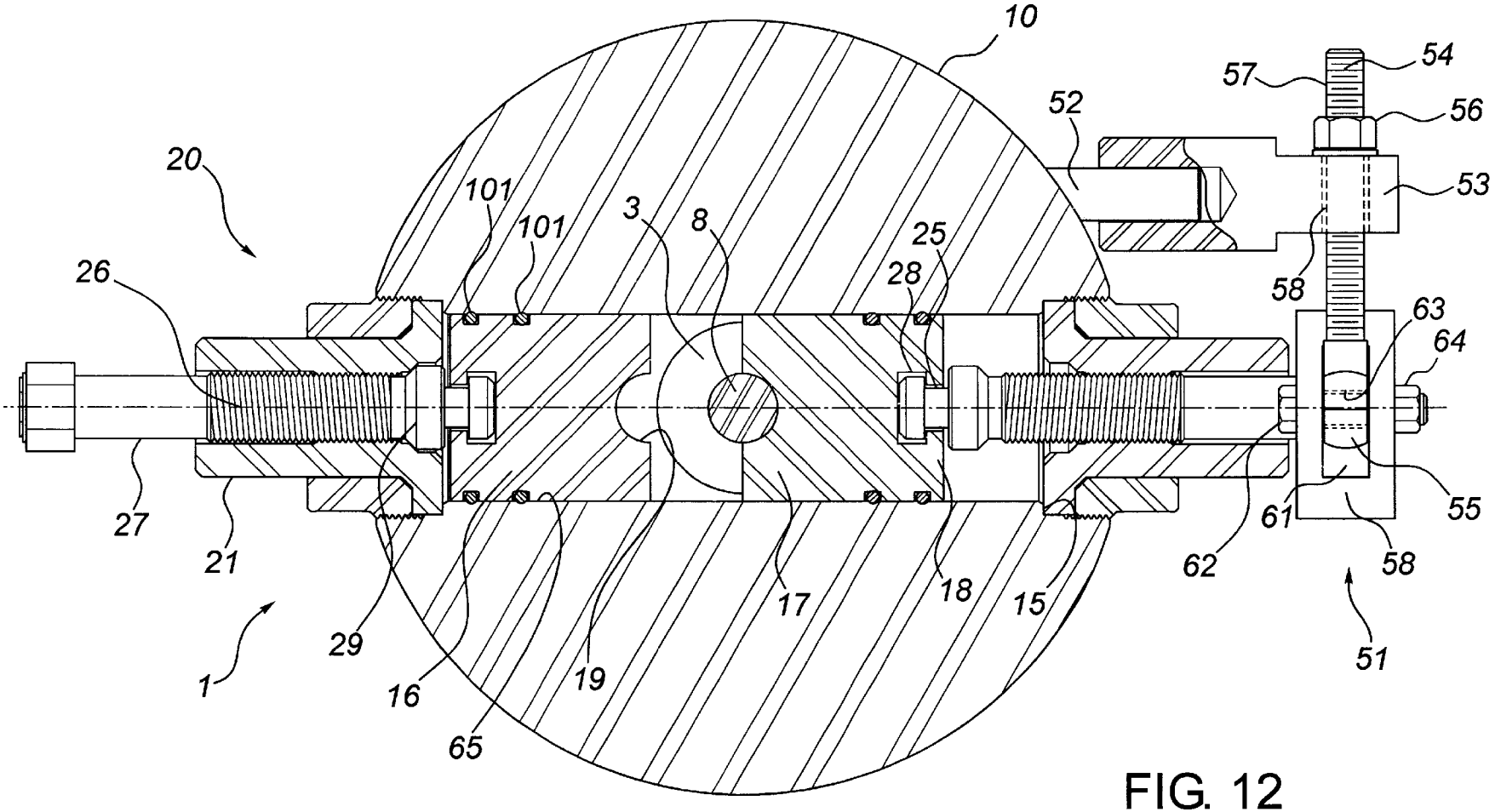
FIG. 12 is a sectional plan view showing a locking member connected with a leverage assembly.
Figure 13:
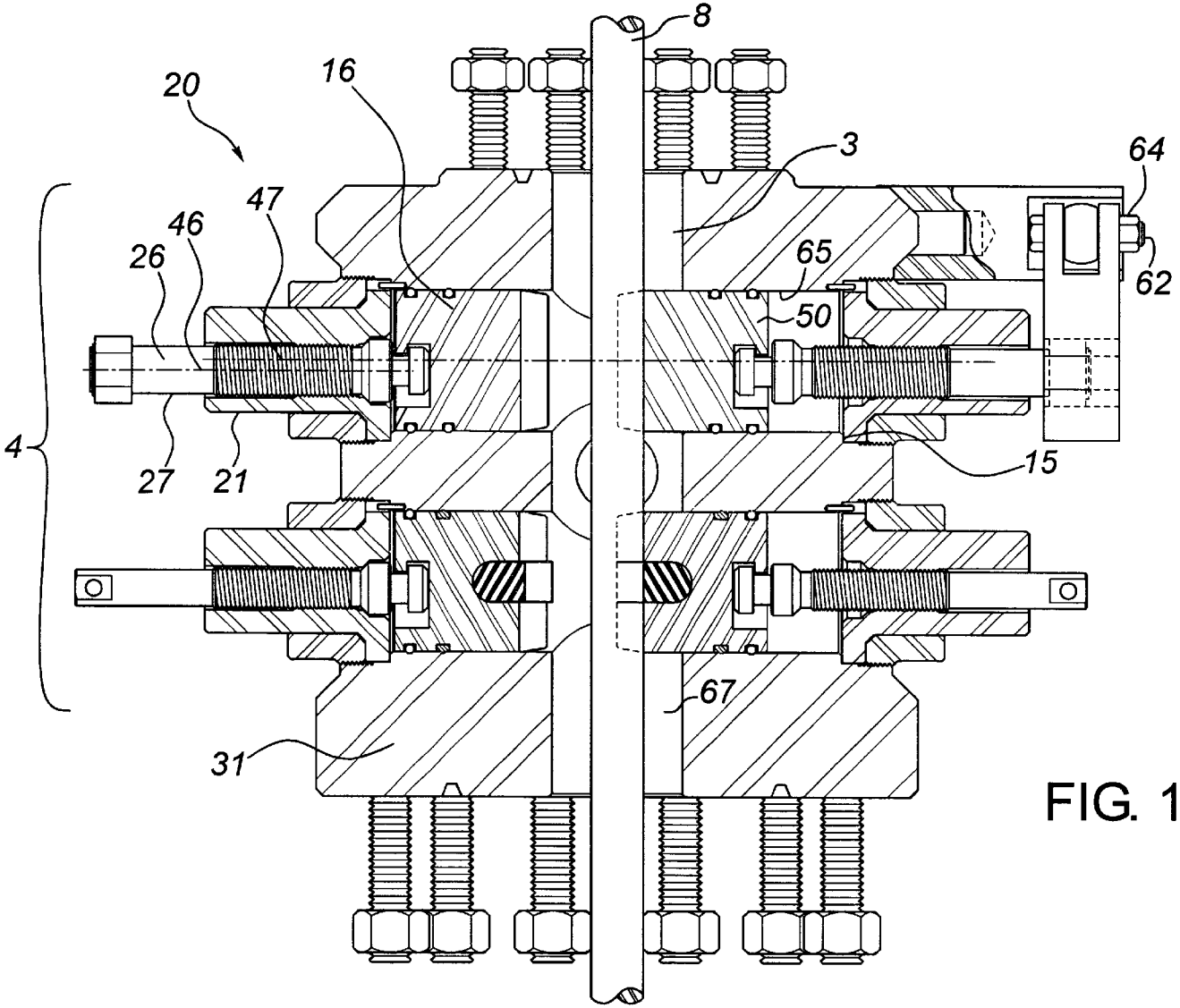
FIG. 13 is a sectional side view showing an upper PRL assembly coupled with a leverage assembly, together with a lower production rod B.O.P.
Figure 14:
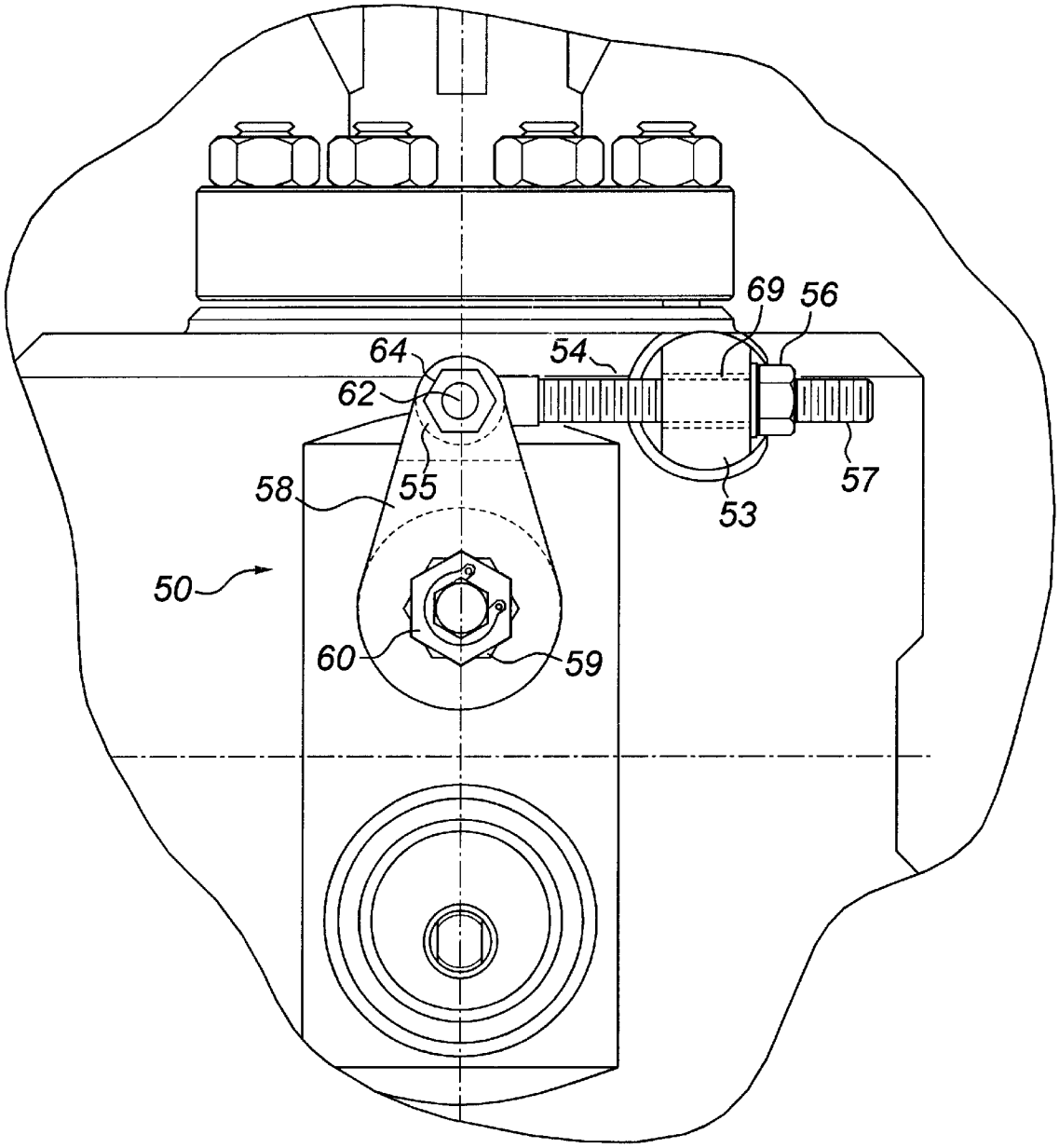
FIG. 14 is an external side view of part of the assembly of FIG. 13.

The leverage assembly 51 is illustrated in FIGS. 12, 13 and 14. It comprises a post 52 affixed to the tree 4. The post 52 extends outwardly in parallel with the adjacent shaft 26. A sleeve 53 is rotatably mounted on the outer end of the post 52. The sleeve 53 can turn on the post 52. The sleeve 53 forms a through-hole 69. A horizontal, externally threaded swing bolt 54 extends through the through-hole 69. At its inner end the swing bolt 54 has an annular head 55. A nut 56 is screwed onto the outer end 57 of the swing bolt 54. The nut 56 abuts the sleeve 53. An arm 58 extends between the swing bolt's annular head 55 and the shaft 26. The arm 58 has a hollow box-like section as shown in FIG. 12. At its lower end, the arm 58 has a transverse hexagonal opening 59. A hexagonal nut 60 is fixed on the shaft's outer end 27. When the arm 58 is added to the leverage assembly 51, its lower end opening 59 receives the shaft nut 60 and the arm 58 engages the nut 60, so that they will turn together. At its upper end, the arm 58 has a second transverse opening 61. A bolt 62 extends through the arm upper opening 61 and through the opening 63 of the swing bolt annular head 55. A nut 64 locks the bolt 62 in place, to effect a pivoting connection between the upper end of the vertical arm 58 and the inner end of the horizontal swing bolt 54.

From the foregoing, it will be appreciated:

- that the swing bolt nut 56 can be turned to cause the swing bolt 54 to linearly retract to the right (having reference to FIG. 14), thereby applying a powerful pull on the bolt 62 linking the arm 58 and swing bolt 54; and
- this bias or pull applied to the upper end of the arm 58 applies powerful torque to the shaft nut 60, causing the shaft 26 to advance to linearly bias the cylindrical member 16 into tight frictional engagement with the polished rod 8.

Figure 15:
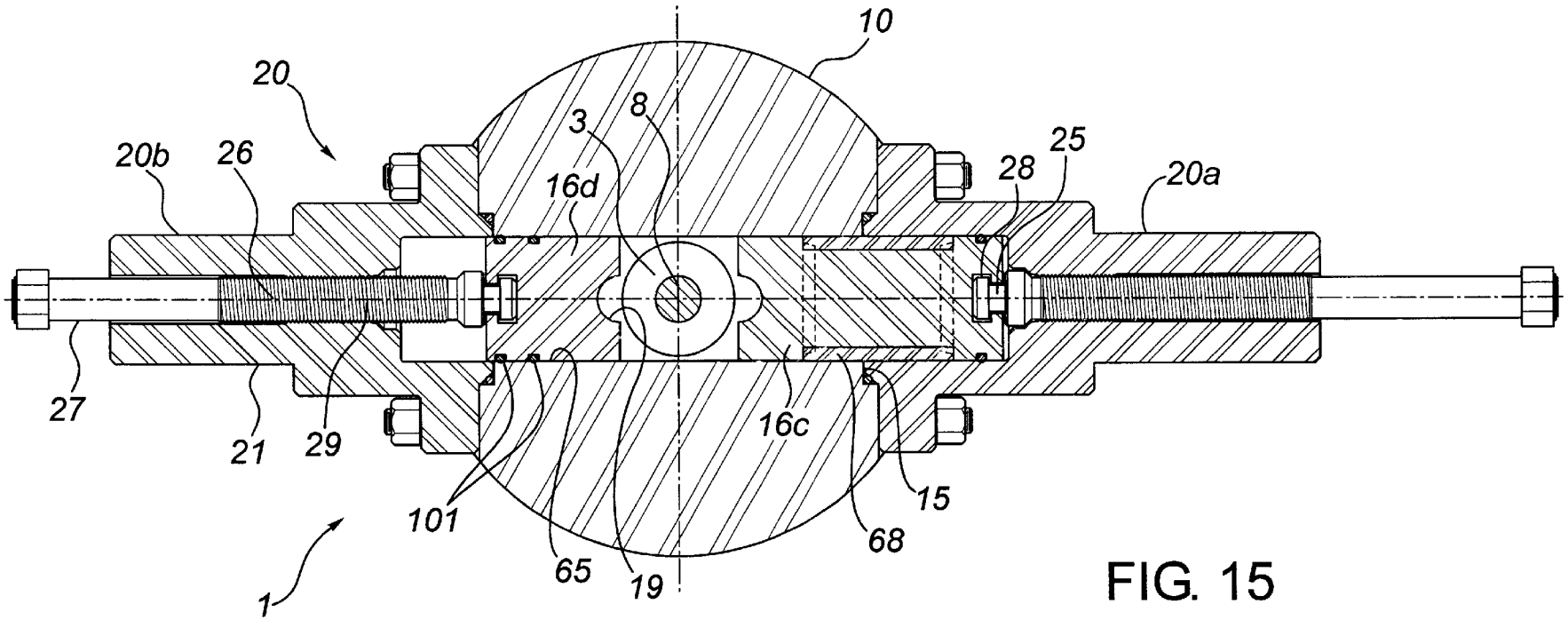
FIG. 15 is a sectional plan view of a PRL assembly, adapted to convert to a blind ram assembly covering the vertical bore, in an open position.
Figure 16:
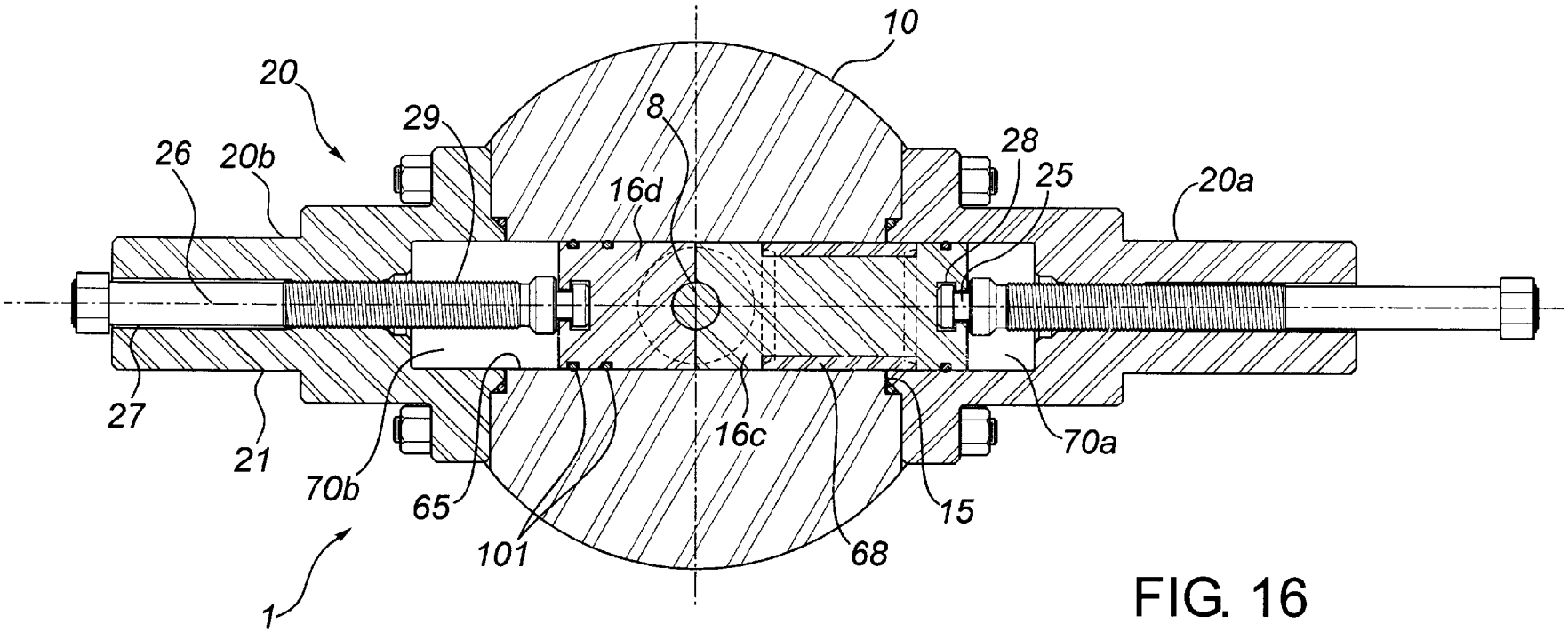
FIG. 16 is a sectional plan view of the PRL assembly of FIG. 15, in a closed rod-engaging position.
Figure 17:
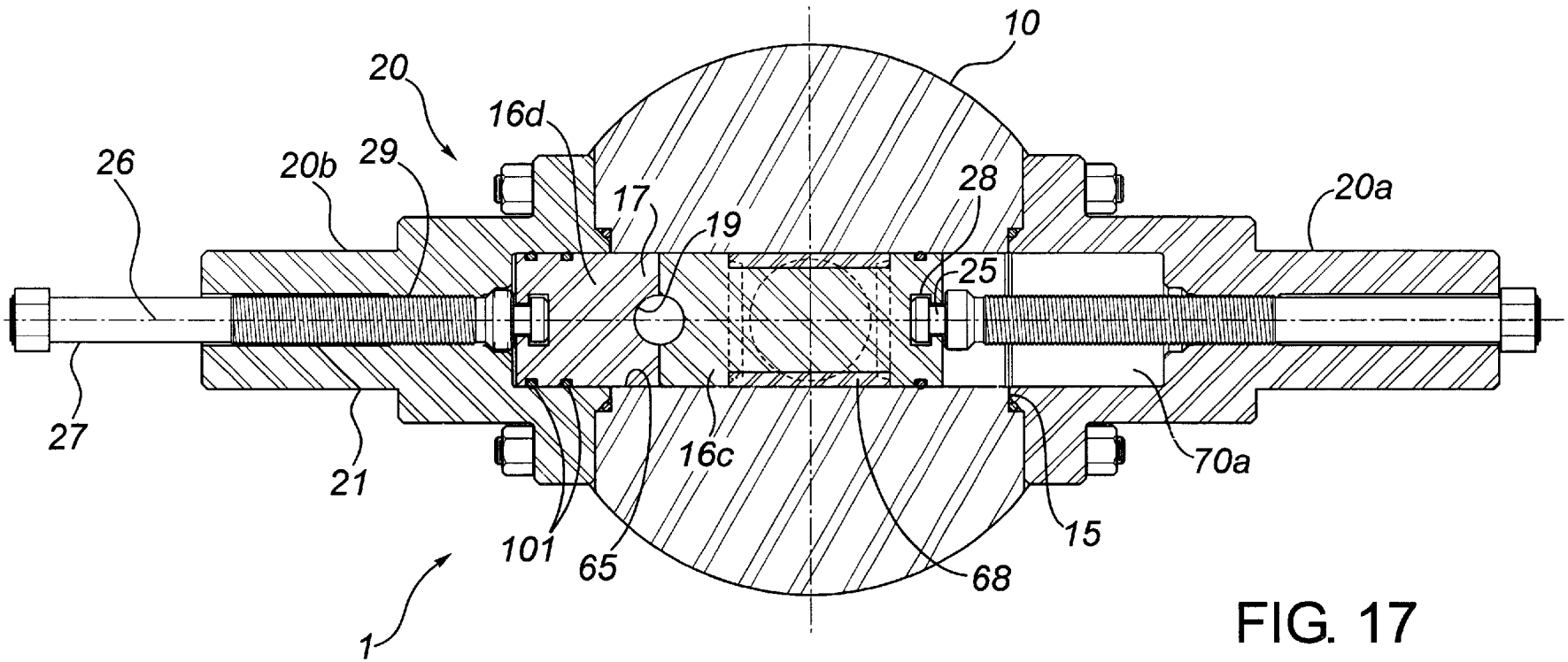
FIG. 17 is a sectional plan view of the PRL assembly of FIG. 16, in a closed blind ram position.

In another embodiment shown in FIGS. 15–17, the PRL assembly 1 comprises relatively long and short gland members 20*a*, 20*b*. One cylindrical member 16*c* is longer than the other cylindrical member 16*d*. One gland assembly 20*a* is relatively longer than the other gland assembly 20*b*. The gland assembly 20*a* forms a longer cavity 70*a* for accommodating the cylindrical member 16*c* in the retracted or open position shown in FIG. 15. The gland assembly 20*b* forms a cavity 70*b* which is adapted to accommodate the cylindrical member 16*d* in the 'blind' position shown in FIG. 17, thereby enabling the cylindrical member 16*c* to cover or extend across the vertical bore 3. The cylindrical member 16*c* carries a suitable seal 68 for sealing the vertical bore 3 and the radial openings 9.

From the foregoing it will be understood that the body means 2 and the locking members 50 co-operate to enable one cylindrical member 16*c* to extend transversely across the vertical bore 3 to close and seal it.

The embodiments of the invention in which an exclusive property or privilege is claimed are defined as follows:

1. A polished rod locking assembly, for use as part of a wellhead production pumping tree to secure a polished rod forming the upper end of a rod string extending through a vertical bore formed by the tree, comprising:

body means having an outer peripheral surface means and forming a central bore, through which the polished rod may extend, and opposed first and second side openings extending between the peripheral surface means and the central bore, each side opening being formed by an internal surface threaded along part of its length;

first and second locking members, each being externally threaded along part of its length and having an inner end face, adapted to thread into the first and second side openings, respectively, for frictionally engaging the polished rod, each locking member being operative to seal against the internal surface of the side opening containing it and having an outer end which will protrude from the body means;

a lever arm for turning the first locking member, the arm having first and second ends, the arm's first end being connectable with the outer end of the first locking member; and mechanical means for biasing the arm's second end to turn the first locking member to increase the force with which the first locking member engages the polished rod after they are in contact, to thereby secure the polished rod.

2. The locking assembly as set forth in claim 1 wherein:

each locking member comprises an inner cylindrical member and an outer threaded shaft, the inner member and shaft being interconnected so that they advance and retract linearly together but the inner member does not rotate with the shaft.

3. In combination:

a wellhead production pumping tree forming a vertical bore through which a polished rod extends; and a polished rod locking assembly, forming part of the tree, for securing the polished rod, comprising:

body means having an outer peripheral surface means and forming a central bore, through which the polished rod may extend, and opposed first and second side openings extending between the peripheral surface means and the central bore, each side opening being formed by an internal surface threaded along part of its length;

first and second locking members, each being externally threaded along part of its length and having an inner end face, threaded into the first and second side openings, respectively, for frictionally engaging the polished rod with their inner end faces, each locking member sealing against the internal surface of the side opening containing it and having an outer end which protrudes from the body;

a lever arm for turning the first locking member, the arm having first and second ends, the arm's first end being connected with the outer end of the first locking member, and mechanical means connected with the tree, for biasing the arm's second end to turn the first locking member to increase the force with which the first locking member engages the polished rod after they are in contact, to thereby secure the polished rod.

4. The combination as set forth in claim 3 wherein the mechanical means comprises:

a swing bolt having an annular head at its inner end forming an opening and an externally threaded outer end;

means for pivotally connecting the outer end of the arm with the swing bolt annular head;

a post having inner and outer ends, the post inner end being secured to the tree;

the swing bolt's outer end being threaded through the outer end of the post; and a nut threaded on the outer end of the swing bolt;

whereby turning of the nut will linearly advance or retract the swing bolt to bias the arm's second end to apply torque to the first locking member to increase the force with which the first locking member engages the polished rod after they are in contact.

5. The combination as set forth in claim 4 wherein:

the tree is an integral unit formed by a single piece of steel; and the body means is integral with the tree.

6. The combination as set forth in claim 3 wherein:

the tree is an integral unit formed by a single piece of steel; and the body means is integral with the tree.

7. The combination as set forth in claim 6 wherein:

the tree has a flanged bottom connection having bolt holes; and the body means is positioned between adjacent pairs of bolt holes.

8. The combination as set forth in claim 3 wherein:

the body means and locking members co-operate to enable one locking member to retract sufficiently to permit the other locking member to extend transversely across the tree vertical bore to close and seal the bore.

* * * * *